United States Patent [19]

Walker

[11] 4,286,665

[45] Sep. 1, 1981

[54] APPARATUS AND METHOD FOR CONDUCTING OFFSHORE WELL OPERATIONS

[75] Inventor: Raymond W. Walker, Huntington Beach, Calif.

[73] Assignee: Deep Oil Technology, Inc., Long Beach, Calif.

[21] Appl. No.: 85,340

[22] Filed: Oct. 17, 1979

Related U.S. Application Data

[63] Continuation of Ser. No. 899,112, Apr. 24, 1979, abandoned.

[51] Int. Cl.[3] ..... E21B 7/12

[52] U.S. Cl. ..... 166/339; 166/342; 166/349; 166/366; 175/7

[58] Field of Search ..... 166/349, 366, 360, 362, 166/363, 368, 339, 343; 175/7, 10; 179/342

[56] References Cited

U.S. PATENT DOCUMENTS

| | | | |
|---|---|---|---|
| 3,137,348 | 6/1964 | Ahlstone et al. | 166/368 |
| 3,177,954 | 4/1965 | Rand | 175/7 |
| 3,179,179 | 4/1965 | Kofahl | 166/352 |
| 3,482,408 | 12/1969 | Manning | 166/366 |
| 3,517,738 | 6/1970 | Petersen | 166/349 |
| 3,721,294 | 3/1973 | Nelson | 166/343 |
| 3,856,037 | 12/1974 | Garrett | 166/368 |
| 3,934,658 | 1/1976 | Nelson | 175/7 |
| 3,973,635 | 8/1976 | Gatlin et al. | 166/349 |
| 3,996,755 | 12/1976 | Kalinowski | 175/7 |
| 4,174,011 | 11/1979 | Zarembe | 166/366 |

*Primary Examiner*—William F. Pate, III

*Attorney, Agent, or Firm*—Poms, Smith, Lande & Rose

[57] ABSTRACT

An apparatus and method for offshore well operations in which a tension leg platform, a multiwell template means, and a riser system are arranged to provide: effective use of the advantages of a tension leg platform, a simplified riser design, and a novel template design which minimizes orientation problems of well equipment at the sea floor. A multiwell template means in which the template frame includes a latch ring member for each well to cooperate with a retrievable guide line base frame having releasable latch members whereby angular or radial orientation of the guide line base frame is not required with respect to the template frame. A retrievable guide line base frame having alignment means thereon and guide posts with guide lines attached thereto.

20 Claims, 14 Drawing Figures

20
24
30
21
21
23
22
23
22
26
25
32
OIL TRANSFER
GAS TRANSFER
FLOW LINES
26
26
28
25
25
WATER INJECTION LINES

Fig. 7.
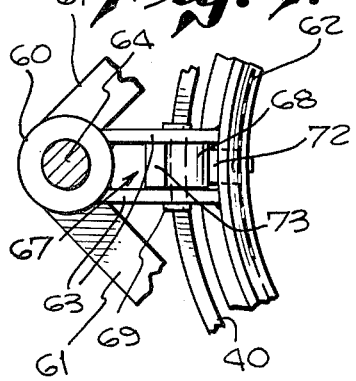
Fig. 8.
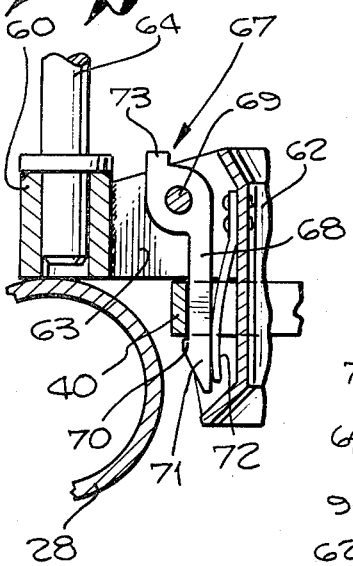
Fig. 9.
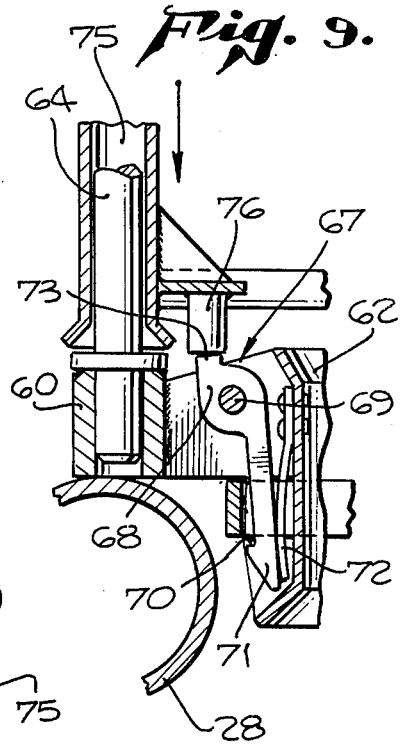
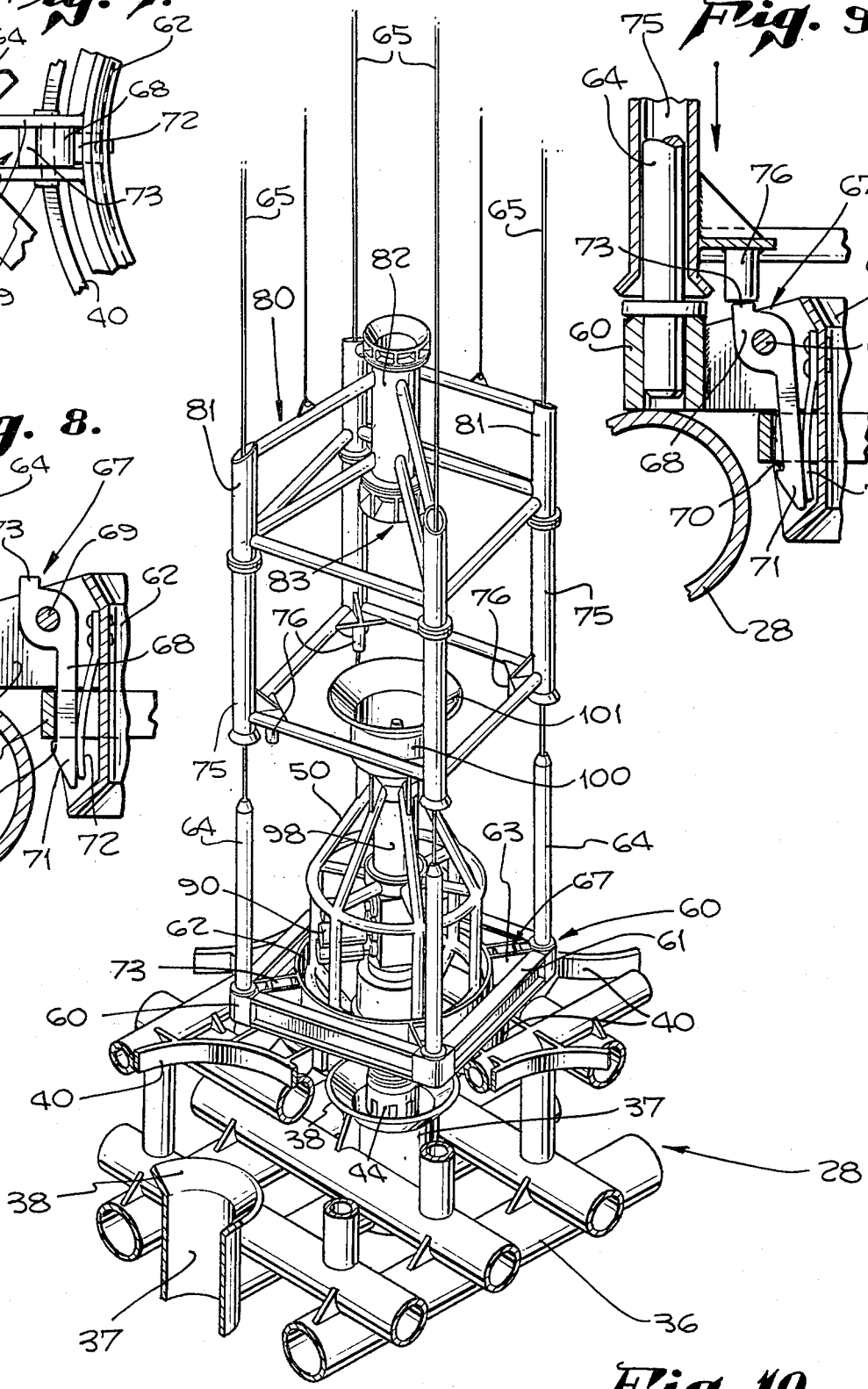
Fig. 10.

APPARATUS AND METHOD FOR CONDUCTING OFFSHORE WELL OPERATIONS

This is a continuation of application Ser. No. 899,112 filed Apr. 24, 1978 now abandoned.

BACKGROUND OF INVENTION

Initially, offshore well operations were conducted from fixed platforms in relatively shallow water. As such operations moved from shallow to deeper water, the cost of fixed platforms became very expensive. In attempts to reduce expense and to conduct well operations in deep water, different systems have been proposed, such as providing a completely submerged production station at the sea floor, providing a floating platform production system in which semisubmersible platforms are utilized, and more recently, providing a tension leg platform production system. In the floating platform production system, a subsea manifold at the sea floor may receive production from satellite subsea wells where individual production risers transmit production flow to the platform where it is processed and then returned to the sea floor manifold for delivery to shore facilities, for temporary storage, or delivered to a tanker. Production and transfer risers in such a system are supported by riser tensioners which accommodate heave of the platform in the order of ten feet.

Tension leg production system involves the use of tension leg platforms, such as described in U.S. Pat. Nos. 3,780,685, 3,648,638, and 3,154,039. Tension leg platforms are characterized by the absence of heave, roll or pitch in response to wave motion and thus provides opportunity for improved production efficiency and simplification of the riser design and tensioning thereof.

In prior proposed offshore well installations, template means for defining the location of a group of wells have been employed. Such template means have been constructed with permanent guide posts associated with each well to facilitate location of the well and to provide means for attaching guide lines to the guide posts for lowering well tools and equipment for maintaining or servicing each well. Such multiwell template means sometimes provided for installation of a wellhead and production modules on the template means which included piping and control lines which required makeup connections at the template. Substantially precise alignment of the pipe and control lines was necessary to make a connection, and this was often difficult in deep water and required the use of divers, diving capsules, mechanical manipulators and robots under remote control and special equipment.

In such prior proposed offshore well operations, riser systems extended from a wellhead at the sea floor to a floating vessel; and as mentioned above, riser tensioning means were required as well as heave compensating means. When such riser systems included any great length in deep water, ball and socket joints were often used at the wellhead to permit lateral movement of the riser caused by water currents and motion of the floating platform. Various systems were used to support the riser to accommodate such motion and change in relative position of the riser and platform.

SUMMARY OF INVENTION

The general concept of the present invention is to utilize the advantages of a tension leg platform which is subject to minimum relative motion with respect to a riser system and to provide an offshore apparatus and method of conducting offshore well operations which are economically feasible and reliable under varying weather conditions. It is contemplated by this invention that risers extending between the tension leg platform and a multiwell template means of this invention remain connected under virtually all weather conditions to avoid the hazards involved with disconnecting, handling and reconnecting risers and to improve production efficiency by reducing downtime due to weather related riser handling operations. The riser tensioning system may be substantially reduced in stroke as compared to conventional heavy long stroke tensioners now in use. As a result of the novel offshore apparatus and method contemplated by this invention, lower initial capital investment is required, less expensive swivel joints and steel connecting pipes may be employed in the process piping on the platform because of quasistatic conditions of the riser pipe with respect to the platform, flexible hoses may be avoided, greater security in case of fire because shut-off is provided at the well template means, multiple riser systems do not become too complex since this invention treats each riser for each well substantially independently and separate. The present offshore apparatus and method contemplated by this invention in its use with a tension leg platform is characterized by a more efficient pound of payload per pound of platform and this efficiency increases with increasing water depth.

The present invention generally contemplates an offshore apparatus or installation which includes a tension leg platform positioned above a well template means at the sea floor, and a riser system which is essentially a continuation of the production pipe in the well hole, the production pipe being provided with a safety valve block at the well template to provide a primary control for the well at the sea floor. The production riser is sized to meet both production and maintenance requirements of the well. At the platform, the production riser may include a production head assembly supported on riser tensioning means, the production head assembly providing secondary control of the well with a secondary master valve, swab valve and wing valves.

The invention also contemplates a sea floor template which locates each well hole in the same array as a cellar deck layout on the tension leg platform. The novel well template of this invention includes a latch ring member for each well which is cooperable with latching members on a guide line base frame whereby the base frame may be latched to the ring member in non-oriented radial or angular position with respect to the well axis. The invention contemplates a novel guide line base frame, a running tool frame cooperable therewith and guidance means on the guide line base frame for axial alignment of the base frame with the latch ring member on the template means.

It is, therefore, a primary object of the present invention to provide an apparatus and method for economically conducting offshore well operations.

An object of the invention is to provide an apparatus and method for offshore well operations utilizing a tension leg platform, a multiwell template means on the sea floor, and a riser system in a novel, effective, economical manner.

Another object of the present invention is to provide a well template means of novel construction and a system of well operations in which orientation of well component parts is substantially reduced and minimized.

Another object of the present invention is to provide a well template means and a retrievable guide base frame releasably cooperable in novel manner.

A further object of the invention is to provide a novel riser system adapted to remain in connected relation with production tubing in virtually all types of weather conditions.

A specific object of the invention is to provide a novel construction and operation of a guide line base frame in association with the construction of a novel sea floor well template means.

Various other advantages and objects of the present invention will be readily apparent from the following description of the drawings in which an exemplary embodiment of the present invention is shown.

IN THE DRAWINGS

FIG. 7 is an enlarged fragmentary sectional view taken in the plane indicated by line VII—VII of FIG. 6 showing the base frame latch means in detail.

FIG. 8 is a fragmentary enlarged view showing said latch means in latched position.

FIG. 9 is a fragmentary enlarged sectional view showing said latch means and engagement of the latch release tool therewith for retrieving the guide line base frame.

FIG. 10 is a fragmentary perspective view showing lowering of the release tool to disengage the base frame from the template means.

Figure 1:
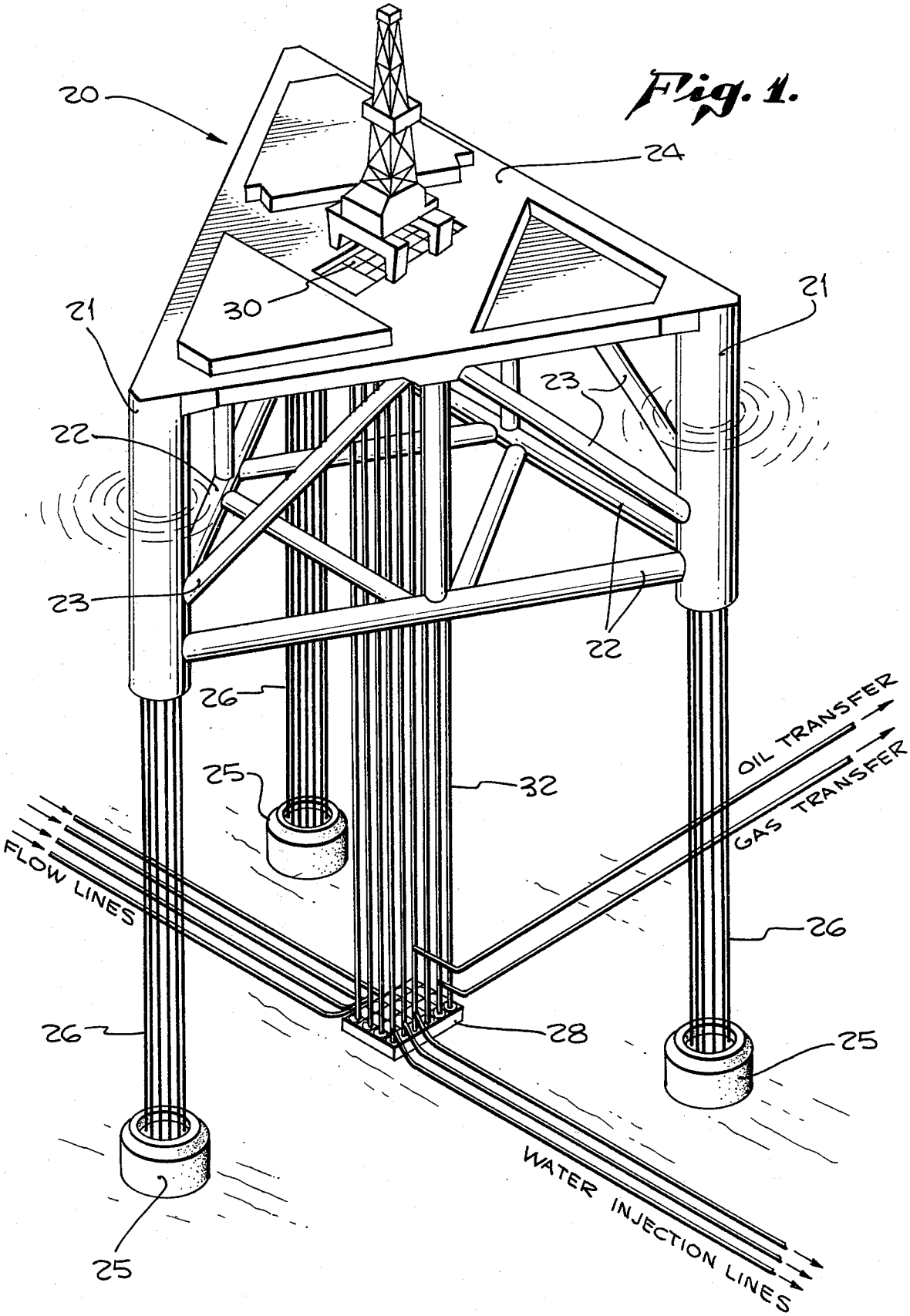
FIG. 1 is a perspective schematic view of a tension leg platform and multiwell template means at the sea floor embodying this invention.

In the drawings, an offshore well installation embodying this invention is generally shown in FIG. 1. A tension leg platform generally indicated at 20 may include the construction described and claimed in U.S. Pat. No. 3,780,685 in which vertical buoyant members 21 are interconnected by horizontal buoyant members 22 and a structural framework generally indicated at 23 for supporting a platform deck 24. Each vertical column 21 is connected with anchor means 25 by tension legs 26 which may include cable, chain, pipe and the like placed under selected tension by selective ballasting of the horizontal and vertical buoyant members 22 and 21. In such a tension leg platform, cable tension variations resulting from wave motion are minimized by optimizing the distribution of vertical-horizontal members to cancel such forces. Such tension leg platform is also designed to absorb horizontal forces developed by wind, wave or current while providing a restoring force to maintain the platform on station. Maximum lateral offset is limited by design to assure that riser stresses remain within acceptable limits.

In such an offshore installation, a multiwell template means 28 is located on the sea floor and locates wells to be drilled and in the same array as a cellar deck and/or platform deck array 30 on the platform 20 when it is positioned over the template means 28.

Figure 12:
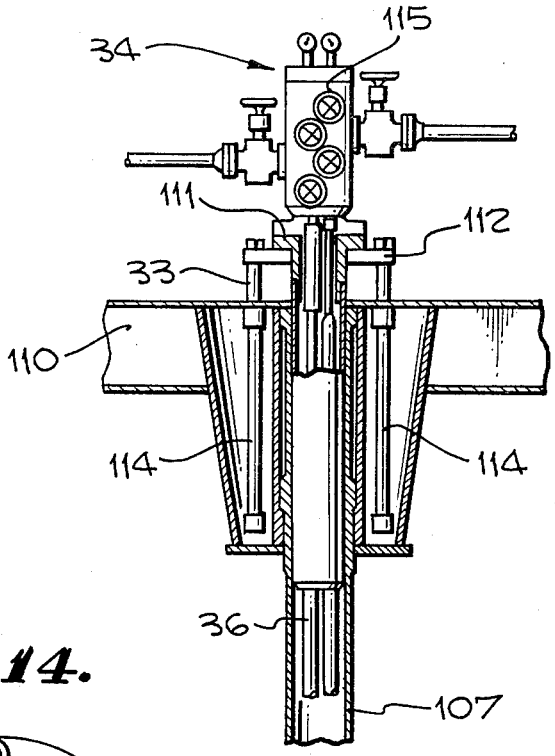
FIG. 12 is an enlarged fragmentary sectional view of the production head and riser tensioning means at the platform, the section being taken in the plane indicated by line XII—XII of FIG. 11.

As generally shown in FIG. 1 in a production mode, one or more riser pipes 32 is associated with each well indicated by template means 28 and extends upwardly through the same relative opening in the cellar deck and in the array 30 on the platform deck for connection to riser tensioner means generally indicated at 33, FIG. 12, above which may be connected a production tree 34. It will be understood that production flow may be treated at the main platform deck to separate gas from oil, that the oil may be transferred to a storage tanker, or returned to the sea floor along a suitable transfer pipe for connection to a flowline to a shore facility or may be transferred to seabed storage facilities. Separated gas may be flared or may be transferred to some other facility for storing.

In detail, one of the features of this invention which contributes to the effectiveness and resultant economies of the offshore installation of this invention includes well template means 28 which may comprise a suitable structural framework 36 which provides one or more template guide funnels 37. Each guide funnel 37 includes an upwardly directed outwardly flared conical surface 38 for guiding well tools into coaxial alignment with the guide funnel 37. Each guide funnel 37 is rigidly connected to lower structural frame portions of template means 36. Upper template frame portions **36*u* support a latch ring member 40 of greater diameter than guide funnel 37 and in coaxial alignment therewith. Latch ring member 40 is rigidly secured in such relation by suitable brackets or gussets 41 welded to the template frame structure 36*u*. Depending upon the number of wells to be drilled and produced, template means 28 may include a plurality of coaxial aligned guide funnels 37 and associated latch ring members 40** in any selected pattern, in this example arranged in parallel rows.

Template means 28 may be lowered to the sea floor in well-known manner and located in substantially horizontal position.

Figure 2:
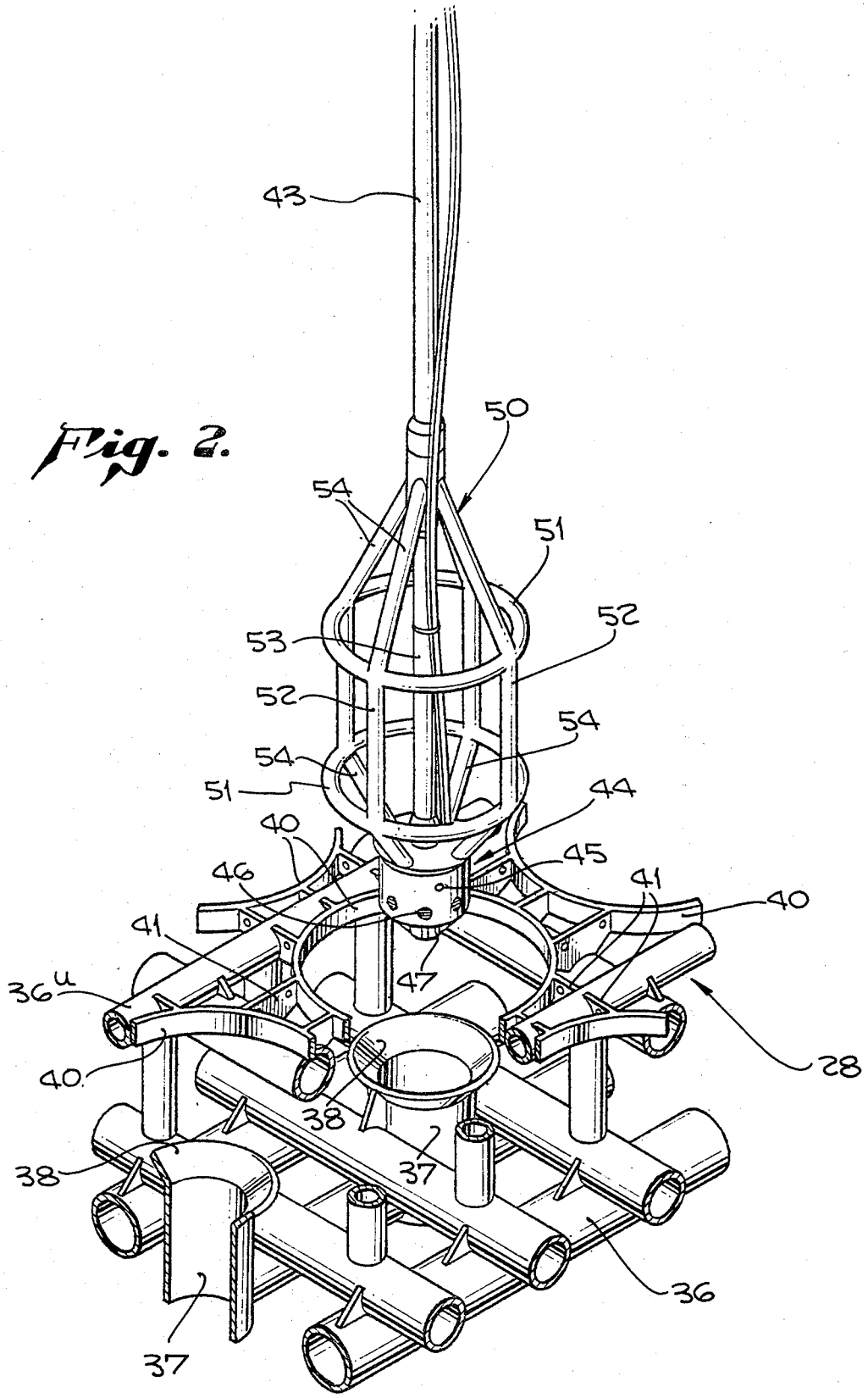
FIG. 2 is a fragmentary perspective view of a portion of the multiwell template showing the approach of a maneuverable tool means to seek the conductor pipe of a selected well hole to initiate drilling.

In conducting drilling operations and the installation of production pipe in the drilled well hole, the invention contemplates novel use of the well template means 28 described above. When contact with the well template is desired for drilling purposes, a stabbing pipe string 43 may be lowered from a drilling vessel (not shown). At the end of the stabbing string (FIG. 2), a pipe string maneuvering tool means generally indicated at 44 is provided for seeking and establishing contact with a selected template guide funnel 37. Tool means 44 is described and claimed in a copending application owned by a common assignee. Tool means 44 briefly includes a tool body member provided with laterally directed thrust means 45 controllable at the drilling vessel for laterally moving the bottom end of the pipe string 43 into a selected position with respect to a guide funnel 37. Tool means 44 also includes position sensing means including sonar and TV camera and associated lights by which an operator at the drilling vessel may observe the downward path of the stabbing pipe string as it is lowered and precisely locate the pipe string with respect to the template means. Tool means 44 also includes remotely operable lock elements for frictional engagement with the internal cylindrical surface of a selected guide funnel 37 to retain the stabbing pipe string in position during landing and handling of other tool equipment associated with a drilling operation. Tool means 44 includes a tapered nose 47 for guiding cooperation with the flared surface 38 to facilitate centering of the pipe string 43 as it is lowered into a selected guide funnel 37. The outer diameter of the tool means 44 is less than the inner diameter of funnel 37 to provide a loose sliding fit therebetween. The annular space of such loose fit is less than the maximum travel of the locking elements 46 on the tool means 44 so that the locking elements may properly frictionally engage the guide funnel 37.

The end of stabbing pipe string 43 is also provided with a stabbing guide means 50 carried above tool means 44 and comprising axially spaced rings 51 interconnected with parallel angularly spaced members 52. Each ring 51 is connected to an axial pipe member 53 by angularly disposed guide members 54 which facilitate centering of the pipe string with the axis of guide funnel 37 and also facilitates centering of other well equipment lowered along the pipe string 43.

After the tool means 44 has entered guide funnel 37 and is located at a depth therein determined by the bottom diagonal members 54 of the stabbing guide means 50, the lock elements 46 of the tool means 44 are actuated to temporarily secure the lower end of the stabbing pipe string 43 in coaxial relation with the guide funnel 37 of the well template.

It will be noted at this point that the well template means 28 is not provided with guide posts nor with means for attaching guide lines to the well template means to facilitate the guiding, landing and retrieval of other well equipment.

Figure 3:
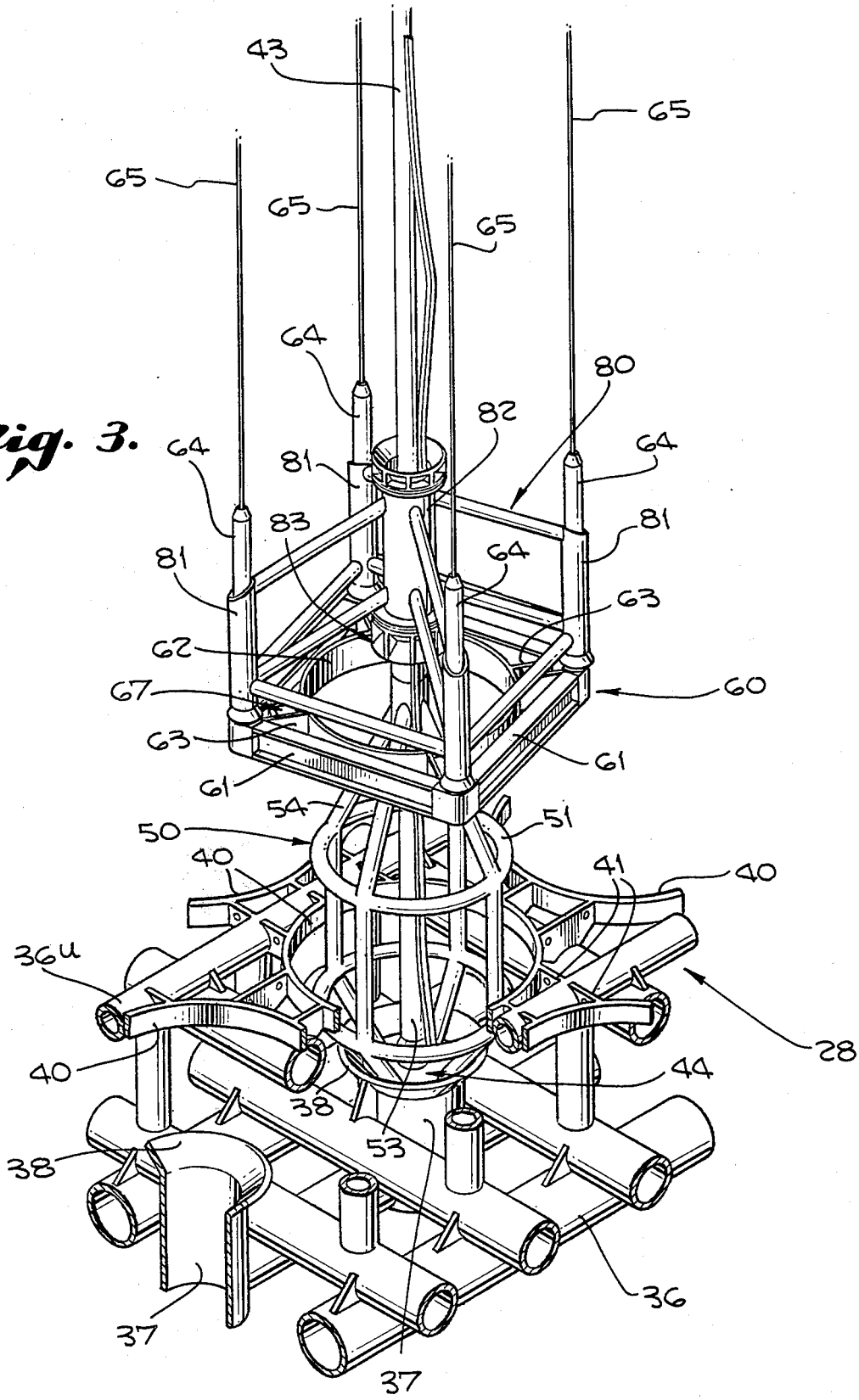
FIG. 3 is a fragmentary perspective view of the template means shown in FIG. 2 illustrating the maneuverable tool in place on the template and the lowering of a retrievable guide line base frame to the template means.
Figure 4:
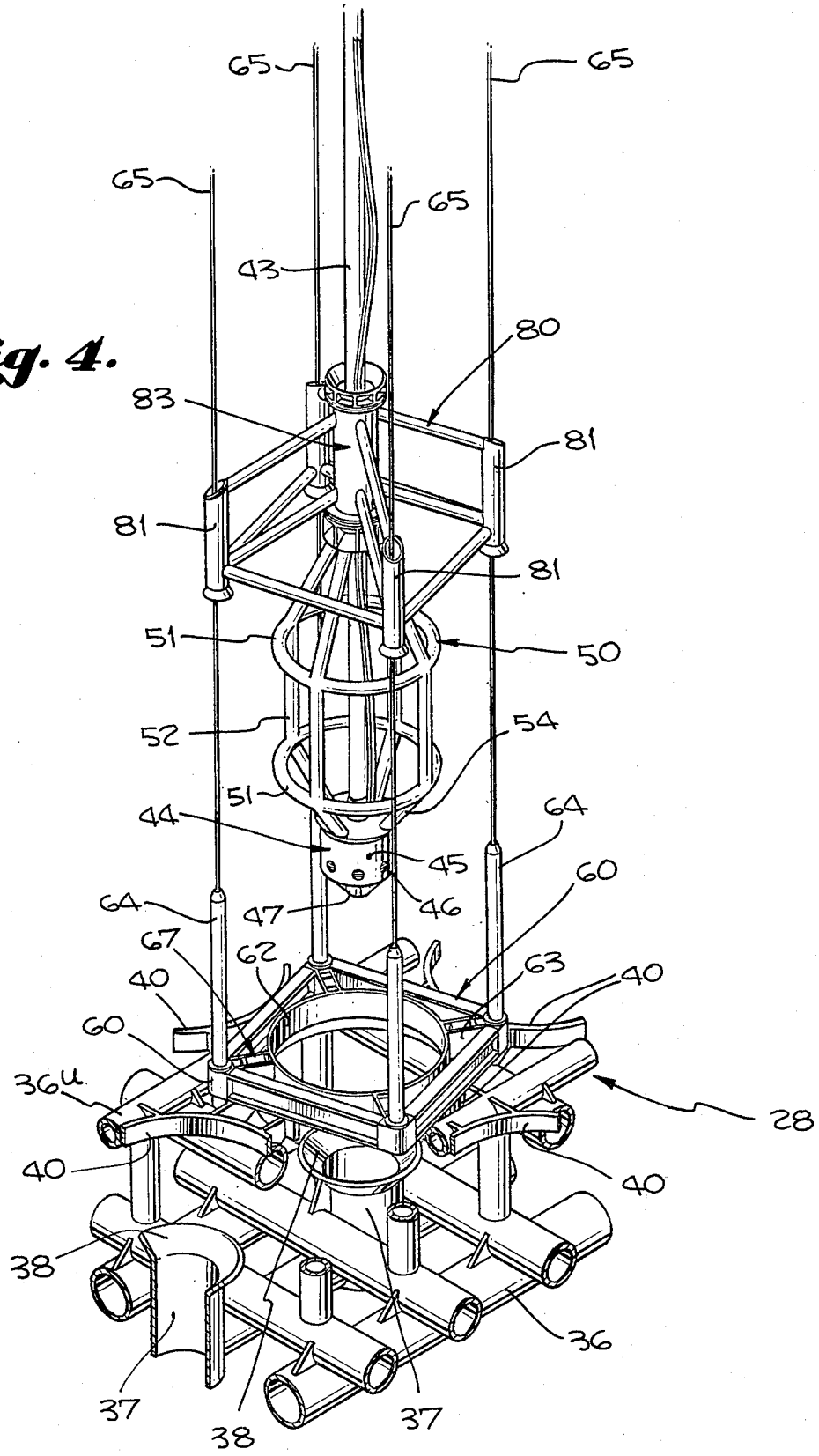
FIG. 4 is a fragmentary perspective view similar to FIGS. 2 and 3 showing the guide line base frame in assembly with the well template means and the retrieval of the maneuverable tool means.
Figure 5:
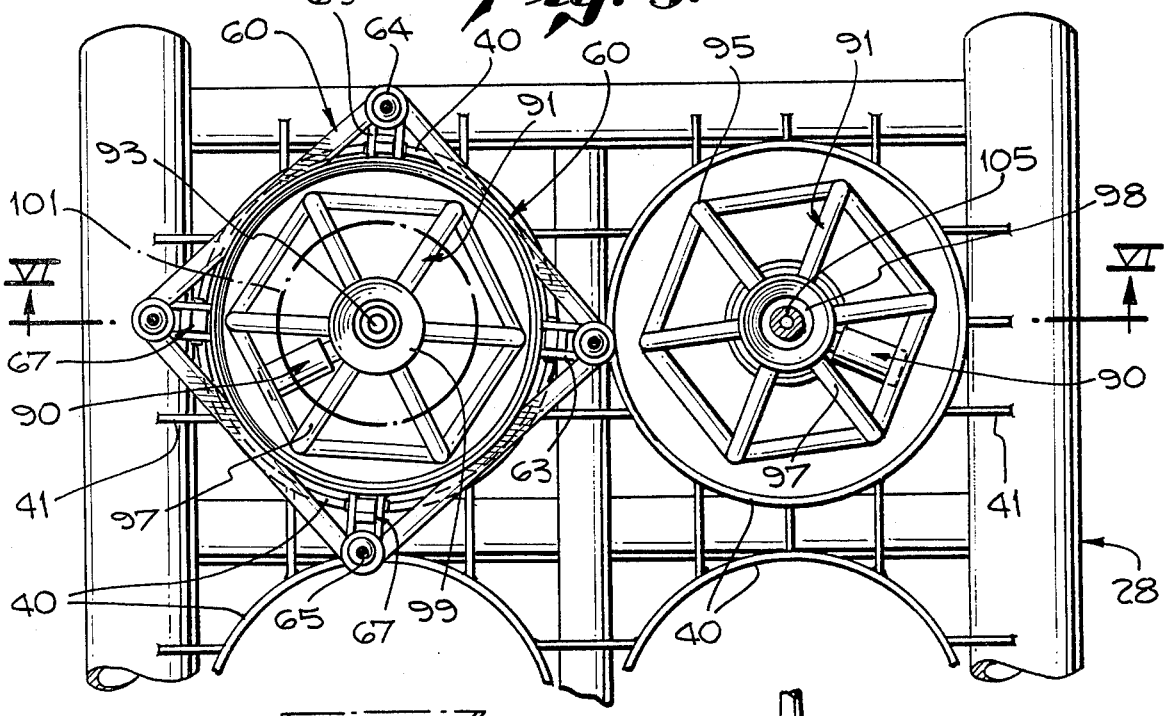
FIG. 5 is a fragmentary plan view of the well template means shown in FIG. 1 illustrating a guide line base frame in non-oriented relation with the template means and a safety valve block means with an abandonment cap thereon associated with the well hole after drilling and suspension of production tubing in the well hole.
Figure 6:
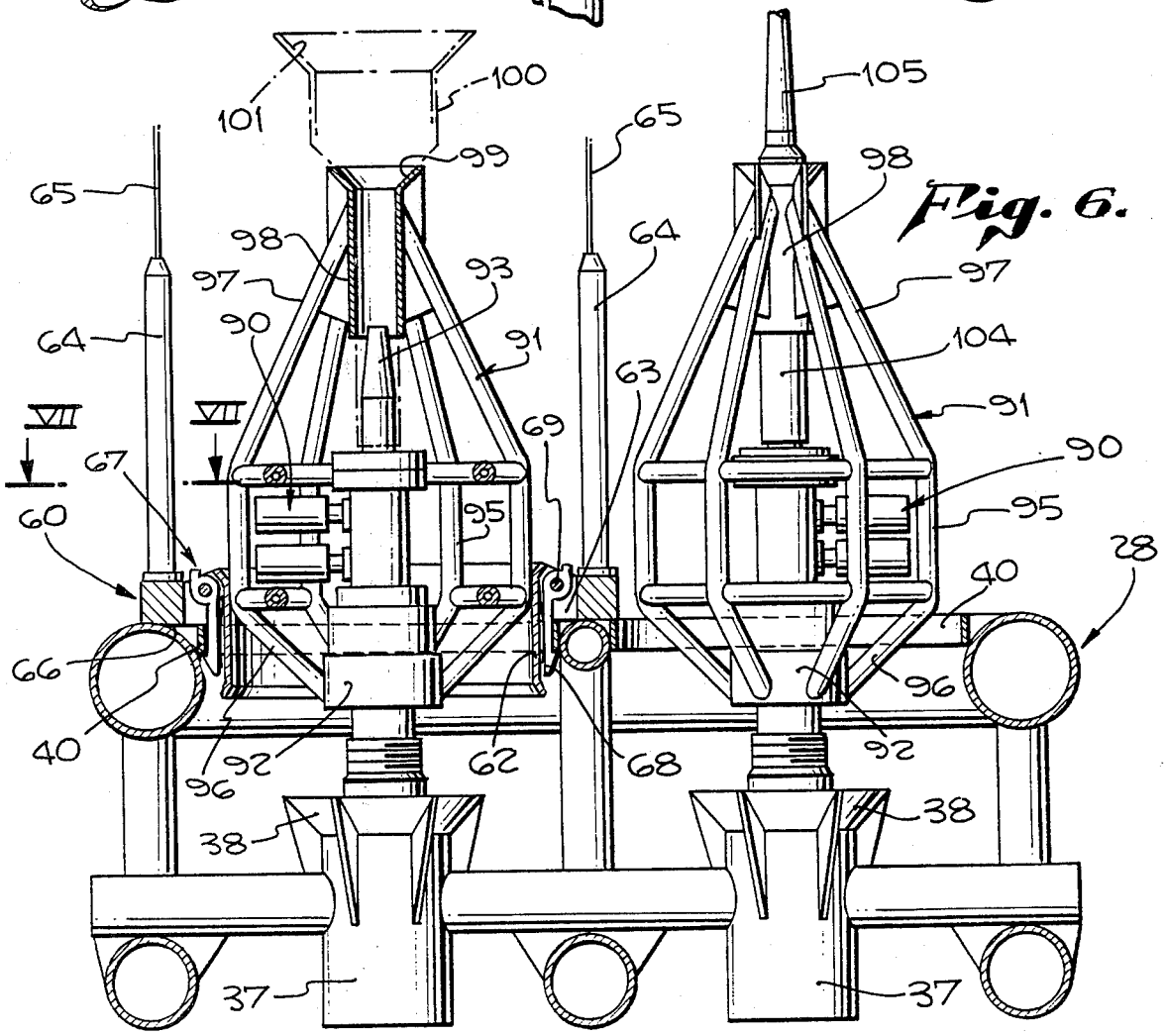
FIG. 6 is a fragmentary sectional view taken in the vertical plane indicated by line VI—VI of FIG. 5.
Figure 11:
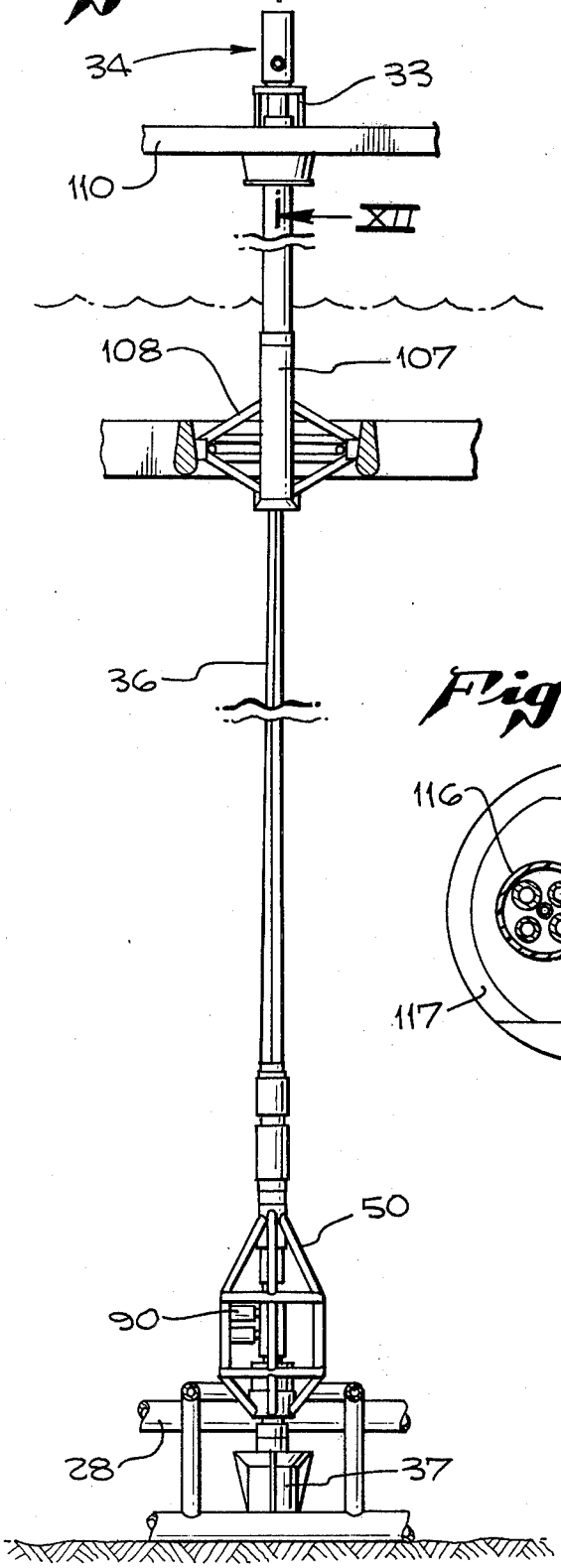
FIG. 11 is a schematic elevational view showing the simplified riser design of this invention in association with the template means, and a tension leg platform.

As shown in FIG. 3, a guide line base frame 60 is adapted to be lowered to the well template means along the stabbing pipe string 43. Base frame 60, in this example, FIGS. 3, 4 includes a rectangular open frame 61 within which is centered and carried a cylindrical guide member 62 serving as a coaxial alignment means for cooperable alignment engagement with the stabbing guide frame 50 and having an outer diameter less than the inner diameter of the latch ring member on the well template means. Cylindrical member 62 is rigidly supported from rectangular frame 61 by spaced parallel gusset plates 63. At each corner of rectangular frame 61, an upstanding guide post 64 is fixedly carried, the upper end of each guide post having fixedly connected thereto guide line 65 of suitable wire rope or cable.

Base frame 60 rests upon well template structure 36*u* as at 66 in coaxial relation to guide funnel 37. The lateral or longitudinal relation of frame 60 to the template structure is random, non-oriented and without reference to the template means or equipment thereon.

Latch means 67, for releasably latching the retrievable guide line base frame 60 to the template means 28, comprises a latch member 68 having its upper end pivotally mounted on a pin 69 which extends between plates 63 and in the space between the cylindrical member 62 and the adjacent corner of the frame 61. The bottom end of latch member 68 has an upwardly directed outwardly facing latch shoulder 70 for engagement with the annular bottom edge face of latch ring member 40 on template means 28. The bottom end of latch member 68 also has an inclined face 71 below latch shoulder 70 to urge latch member 68 radially inwardly as face 71 engages the top edge of latch ring member 40 as the base frame 60 is lowered into engagement with the well template means. It will be noted that the pivotal axis provided by pin 69 lies above and slightly radially outwardly of the inner surface of latch ring member 40. A leaf spring member 72 normally biases latch member 68 radially outwardly so that the latch member will snap into latched position as latch shoulder 70 clears the bottom edge of latch ring member 40.

Each latch member 68 is also provided with an upwardly directed release boss 73 located radially outwardly of the axis of pin 69. Release boss 73 is cooperable with a release tool 75, FIG. 10, which includes a downwardly projecting release boss 76 for contact with the upstanding release boss 73 on the latch member for pivoting the latch member radially inwardly for disengagement of latch shoulder 70 with latch member 40. Such disengagement is accomplished by gravity pressure engagement of the release tool 75 with the latch release boss 73.

It is important to note that guide line base frame 60 is readily coaxially aligned with guide funnel 37 and latch ring member 40 as it is lowered over the stabbing guide frame 50. Radial or angular orientation of base frame 60 and the relative position of guide posts 64 with respect to the template means is not required for installation of the base frame 60 on the template means. The latch means on base frame 60 are readily engageable with the latch ring member 40 at any location along the 360° circumference of the latch ring member 40. Further, since well template means 28 is not provided with fixed guide posts, there may be some encroachment of the guide line base frame 60 into the working area of an adjacent well hole as indicated. Since guide base frame 60 is retrievable, the guide base frame may be utilized in the servicing of other well holes by lowering the guide frame thereto in the manner described above.

As shown in FIG. 3, guide base frame 60 is lowered along the pipe string 43 by means of a running guide frame 80 which includes guide sleeves 81 for releasable engagement with guide posts 64. Running frame 80 includes an axial central pipe 82 slidably receiving therethrough stabbing pipe string 43 and associated control lines.

After the well has been drilled and the production tubing in the well has been landed and suspended within the well-head, a safety valve block means generally indicated at 90 and carried within a protective cage means 91 may be connected with the wellhead mandrel 85 by utilizing the guide lines provided with the guide base frame 60. Cage means 91 is described and claimed in a copending application owned by a common assignee. Safety valve block means 90 may be connected to the wellhead by a hydraulic connector 92 in well-known manner. Safety block means 90 may include open fall-safe safety block valves for the production pipe and for the tubing-casing annulus and is the primary control point for each well. The safety block means 90 includes an upstanding mandrel 93 for connection to a riser connector in well-known manner. The block means 90 and riser connector 93 are located within the cage means 91 for protection.

Cage means 91 includes a central portion 95, a lower inclined end portion 96 and an upper inclined portion 97, said bottom inclined portion 96 facilitating guiding assembly of the cage means with the guide line base frame 60 for coaxial alignment of the safety block means with the upper end of the wellhead mandrel. The upper end portion 97 includes a cylindrical alignment pipe 98 having an outwardly flared upper end 99 upon which may be seated a funnel shaped abandonment cap 100. Abandonment cap 100 is adapted to be assembled with the cage means 91 when the well is to remain unconnected to a production riser string for any length of time.

The upper outwardly flared portion 101 of the abandonment cap functions in a manner similar to the outwardly flared surface 38 of a template guide funnel 37 in order to facilitate reentry of the tool 44 and the stabbing pipe string for reentry and assembly of the guide line base means 60 in the event the guide line base means 60 used during the initial drilling of the well has been retrieved and used for other well holes. The landing and assembly of the guide line base frame 60 with an abandonment cap 100 on the well is accomplished in the same manner as above described with respect to the template guide funnel 37.

After the abandonment cap 100 has been removed by the running tool, a production riser carrying a riser connector 104 may be lowered using running guide frame 80 guiding on lines 65, coaxially aligned with the central guide pipe 98 in the cage means 91 and connected to the upstanding riser mandrel 93 on the safety block valve means 90. Running guide frame 80 may have release tool 75 attached thereto if desired. Such a production riser string 32 preferably includes a lower tapered riser section 105 extending upwardly from the upper portion of the cage means 91. The tapered riser section provides controlled bending of the riser string at its lower portion and obviates the need for a ball and socket joint when used with a tension leg platform where relative motion of the riser pipe, safety block valve means and platform is relatively limited because of the features of the tension leg platform installation.

Riser pipe string 36 extends upwardly to the platform and at the submerged pontoon level of the platform may enter a hawse pipe 107 centralized at the pontoon level by alignment means 108 described in my copending application Ser. No. 749,159. The hawse pipe extends upwardly to deck 110, FIG. 12. Riser pipe 36 extends above deck 110 and the upper end of the hawse pipe 107 and carries a tubing hanger 111 and a tension plate 112 which is connected with a plurality of riser tensioning piston and cylinder means 114. Because of limited motion of the tension leg platform, relative movement between the platform and the upper end of the riser pipe string is relatively small and in the order of plus or minus two feet at the most extreme offset of the platform with respect to the template means. A production tree 115 is connected to the upper end of the riser pipe 36 and provides secondary control of the production well with a secondary master valve, swab valve and dual wing valves (not indicated). The production head may connect to pipelines on the platform by means of swivel connections and pipe (not shown), instead of flexible hoses.

It will be apparent from FIG. 1 that a riser pipe 32 may be installed with respect to each well hole drilled and each riser pipe is separate and independent of the adjacent riser pipe. Each riser pipe is individually tensioned. Each riser pipe 32 in the group responds to wave conditions and relative motion between the platform and the well template means in virtually the same manner, even though individual riser pipes may be carrying fluid of different density and temperature and at different flow rates. Intermingling or contact between adjacent riser pipes 32 which might create unwanted conditions and hazardous loads is avoided. In the event of severe weather conditions, the safety valve block means at the template means for each well hole serves as a primary control for each well, and each well may be shut off at the sea floor while the riser pipe maintains its connection to the block means. All well operations normally performed at a production head or Christmas tree may be conveniently and readily performed at the platform deck where the wellhead equipment providing secondary control is readily available.

Figure 14:
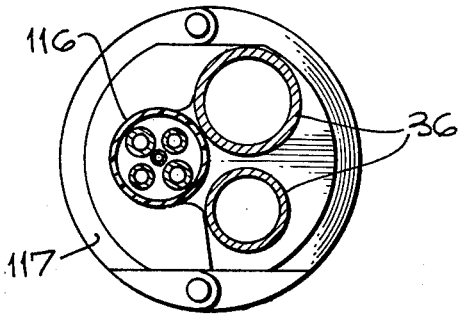
FIG. 14 is a sectional view taken in the plane indicated by line XIV—XIV of FIG. 13.
Figure 13:
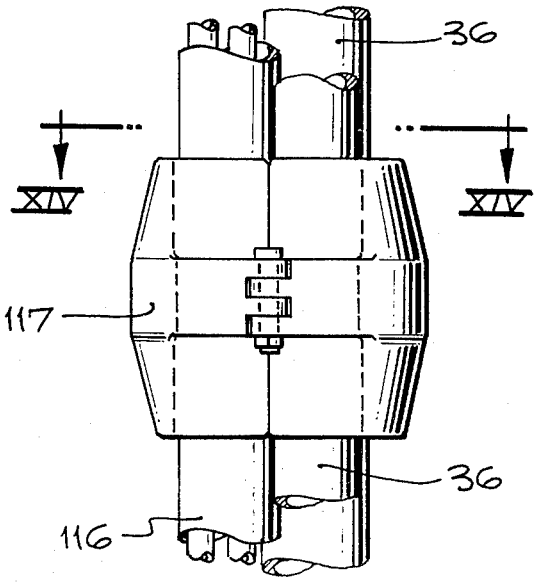
FIG. 13 is a fragmentary view of a clamp means for use with the riser string and umbilical lines associated therewith.

Control means for the safety valve block means and down hole equipment may include control umbilical line 116 clamped to riser pipe 36 by clamp means 117 in suitable manner as shown in FIGS. 13 and 14. Such control functions provided by umbilical line 116 include control lines for operating open fail-safe, down hole safety valves, open fail-safe safety block valves, lock riser connector, unlock riser connector, lock safety block connector, unlock safety block connector, open fail-safe annulus valve and a line for communication of the annulus with the platform.

It should be noted that in the initial seeking and landing of the tool means 44 with a template guide funnel 37 on the template means that the stabbing string is lowered with control lines for jet thrustors, TV cable, lights, latch means, etc. secured externally thereof so that continuous control of the lower end of the stabbing string is maintained.

It should also be noted that after drilling the weight of the production tubing and casing string is carried by the wellhead means at the sea floor. Further, the primary control of the well is located at the sea floor wellhead means. The riser pipe string provides a means for extending communication of the annulus and production flow from the sea floor wellhead means to the tension leg platform where a production tree affords secondary control of the well. The riser pipe string has little relative movement with respect to the wellhead means or to the tension leg platform because of the non-heave characteristic of a tension leg platform. Thus, the arrangement of the wellhead means with primary well control, riser pipe string, production or wellhead at the platform with secondary control of the well, and a tension leg platform to minimize riser tensioning stresses provides an effective, economic offshore installation.

The advantages of the apparatus and method of conducting offshore well operations as described above will be readily apparent to those skilled in the art. The provision of a non-oriented guide line base frame for connection to a novel template means results in economies in equipment and operation which are not possible with prior proposed offshore apparatus and method of operating.

Various modifications and changes may be made in the apparatus and method of this invention described above and all such changes and modifications coming within the scope of the appended claims are embraced thereby.

I claim:

1. In combination:

a sea floor template frame means for one or more wells each having a well axis including a latch ring member provided with an annular engagement face on said template means arranged coaxial to each well axis;

a retrievable guide line base frame adapted to be lowered in coaxial relation with a selected well axis and freely movable around said selected well axis relative to said ring member for random positioning in any angular relation to said ring member;

and latch means on said guide line base frame cooperably engageable with said annular engagement face on said latch ring member on said template frame means in any random angular position of said guide line base frame about said well axis relative to said ring member.

2. A combination as stated in claim 1 wherein said guide line base frame includes a cylindrical member receivable within said latch ring member for coaxially guiding and aligning said guide line base frame with said axis;

said latch means being radially outwardly of said cylindrical member.

3. In combination:

a sea floor template frame means for one or more wells including a latch ring member on said template frame means arranged relative to a well axis;

a guide line base frame adapted to be lowered in coaxial relation with said well axis and freely movable around said axis relative to said ring member;

and latch means on said guide line base frame cooperably engageable with said latch ring member on said template frame means in any angular position of said guide line base frame about said axis relative to said ring member;

said latch means on said guide line base frame including;

a pivoted release means on said base frame for disengagement of said guide line base frame from said latch ring member on said template frame means.

4. A combination as stated in claim 3 wherein said pivoted release means includes a pivot axis, a latch element inboard of said pivot axis, and a pressure contact element outboard of said axis; and a release tool means movable along guide lines of said guide line base frame for pressure contact with said outboard element of said release means for said latch means for disengagement of said latch means with said latch ring member.

5. A sea floor template means for subsea drilling and production operations including:

a template frame means for one or more wells;

a guide funnel means on said template frame means for providing a well axis;

and an open ring member provided with an annular engagement face concentric with said well axis and for receiving therewithin, locating, and releasably securing a component well part in any angular and coaxial relation to said well axis.

6. A sea floor template means as stated in claim 5 wherein said annular engagement face on said ring member is continuous around said axis and is provided on the bottom edge face of said ring member.

7. A retrievable guide line base frame means for well operations to be conducted over a single well having a well axis comprising:

a polygonal base frame provided with guide post means at corners thereof having guide line means attached thereto;

said base frame having an open-ended cylindrical guide member within said base frame;

said cylindrical member having an axis positionable in coaxial relation with said well axis;

said base frame having latch means radially outwardly of said cylindrical guide member and adapted to releasably engage a ring member outwardly thereof on a template frame and having an axis coaxial with said well axis in any angular position of the frame relative to the ring member.

8. In a method of conducting offshore well operations in which a well template means is located on a sea floor, said well template means having a well hole guide funnel for each well and a latch ring member coaxial with each guide funnel, the steps of:

lowering a well hole selector and stabbing guide means into temporary engagement with a selected well hole guide funnel;

lowering along the stabbing guide means a retrievable guide line base frame having a guide line attached thereto;

latching said retrievable base frame onto said latch ring in any non-oriented angular relationship with the axis of the guide funnel;

said step of lowering the retrievable guide line base frame including releasably attaching a running guide frame to said base frame.

9. A method as claimed in claim 8 including releasing said stabbing guide means from said well hole guide funnel and retrieving said stabbing guide means and running guide frame.

10. In a method as stated in claim 8 including the steps of suspending production pipe in the well hole with safety valve block means at the well template frame;

and providing a protective cage for said safety valve block means.

11. In a method as stated in claim 10 including the steps of lowering and connecting riser pipe to said safety valve block means by guiding said riser pipe along said guide line;

and retrieving said guide line base frame means.

12. In a method of conducting offshore well operations in which a well template means is located on a sea floor, said well template means having a well hole guide funnel for each well and a latch ring member coaxial with each guide funnel, the steps of:

lowering a well hole selector means into temporary engagement with a selected well hole guide funnel;

lowering along the selector means a retrievable guide line base frame having a guide line attached thereto for engagement and release of the base frame with said well template means;

latching said retrievable guide line base frame onto said latch ring member in any angular position relative to the latch ring member and to said axis;

and releasing said guide line base frame from said well template means after a well operation, said step of releasing said base frame including the step of lowering a running guide frame into contact with said base frame to unlatch said guide line base frame.

13. In an offshore production well installation, the combination of:

a tension leg platform having a plurality of tension legs connected to anchor means at the sea floor for minimizing heave of said platform;

a multi-well template means located on the sea floor beneath said tension leg platform;

said template means including a guide funnel for each well hole;

a wellhead at the template means for supporting production tubing and well casing below the sea floor at an associated well hole;

means for primary control of production fluid of said well at the sea floor including safety valve block means connected to said production tubing at said template means;

a plurality of production risers each including a riser connector at said safety valve block means, each of said risers extending to said platform;

riser tensioning means of relatively short travel connected to each of said risers at said platform; and means for secondary control of production fluids of said wells at said platform and including wellhead means for each production riser.

14. In an offshore well installation as claimed in claim 13 wherein each of said production risers have a tapered riser portion extending from said safety valve block means.

15. In an offshore well installation as claimed in claim 13 wherein said template means includes at each guide funnel a latch ring member adapted to cooperate in non-oriented relation with a guide line base frame lowered from said platform.

16. In an offshore well installation as claimed in claim 13 including a latch ring member on said template means at each well hole;

a guide line base frame adapted to be lowered from said platform for latching engagement with said latch ring member of a selected well hole for conducting a well operation;

and a running frame means adapted to be lowered from said platform to unlatch said guide line base frame for retrieval thereof.

17. In an offshore well installation as claimed in claim 13 including a cage means surrounding and protecting said safety valve block means.

18. In an offshore well installation as claimed in claim 17 including riser connector means within said cage means for connecting said wellhead at said template means to an associated riser.

19. In combination:

a sea floor template frame means for one or more wells including a latch ring member provided with an annular engagement face on said template frame means arranged coaxial to a well axis;

a retrievable guide line base frame adapted to be lowered in coaxial relation with the said well axis and freely movable around said axis relative to said ring member for positioning in any angular relation to said ring member;

and latch means on said guide line base frame cooperably engageable with said annular engagement face on said latch ring member on said template frame means in any angular position of said guide line base frame about said axis relative to said ring member;

said latch means including a pivoted latch element biased in a radial outward direction with respect to said well axis and engageable with said annular engagement face on said latch ring member.

20. In combination:

a sea floor template means including a plurality of well hole guide funnels each funnel having a well axis and each funnel encircled by a latch ring having an axis common to the axis of its associated well funnel;

a guide line base frame including a cylindrical member adapted to be lowered along said well axis for positioning within said latch ring in coaxial non-radially oriented relation;

and latch means on said base frame engageable with said latch ring in any non-radially oriented position of said frame and cylindrical member at said template means.

* * * * *